US005681254A

United States Patent [19]

Dufour et al.

[11] Patent Number: 5,681,254

[45] Date of Patent: Oct. 28, 1997

[54] MECHANISM FOR APPLYING A BIASING FORCE IN A FOLDER APPARATUS

[75] Inventors: Charles H. Dufour, Durham; Louis J. Doucet, Salem; Joel W. Lee, Rochester, all of N.H.

[73] Assignees: Heidelberg Harris, Inc., Dover, N.H.; Heidelberger Druckmaschinen AG, Germany

[21] Appl. No.: 677,990

[22] Filed: Jul. 10, 1996

Related U.S. Application Data

[63] Continuation of Ser. No. 312,581, Sep. 27, 1994, abandoned.

[51] Int. Cl.[6] ..... B65H 29/12

[52] U.S. Cl. ..... 493/416; 271/274; 198/626.4; 198/626.6

[58] Field of Search ..... 271/69, 70, 67, 271/274; 198/626.6, 626.4; 493/424, 416, 423

[56] References Cited

U.S. PATENT DOCUMENTS

| | | | |
|---|---|---|---|
| 3,386,565 | 6/1968 | Carter | 198/626.6 |
| 3,951,257 | 4/1976 | Storace | 198/626.6 |
| 4,936,564 | 6/1990 | Hain | 271/274 |
| 5,067,701 | 11/1991 | Dekker | 271/274 |
| 5,112,033 | 5/1992 | Breton | 270/47 |

*Primary Examiner*—Jack W. Lavinder
*Attorney, Agent, or Firm*—Kenyon & Kenyon

[57] ABSTRACT

A folder apparatus includes at least one lead-in mechanism, having a left lead-in tape and a left exit roller and a corresponding right lead-in tape and a right exit roller, the right and left lead-in tapes forming a signature passage for delivery of signatures. The right exit rollers rotate about a first axis, the left exit rollers rotate about a second axis. Spring means are assigned to at least on of the lead-in tapes above the corresponding lead-in tape rollers for biasing the tapes.

20 Claims, 4 Drawing Sheets

MECHANISM FOR APPLYING A BIASING FORCE IN A FOLDER APPARATUS

This application is a continuation of application Ser. No. 08/312,581, filed on Sep. 27, 1994, now abandoned.

FIELD OF THE INVENTION

The present invention relates to a mechanism in a folder apparatus for applying a biasing force on conveying tapes.

BACKGROUND OF THE INVENTION

U.S. Pat. No. 5,112,033 discloses a folder apparatus for a web-fed printing press. Signatures which have been severed from a web between a pair of cutting cylinders emerge from the nip between the pair of cutting cylinders and are fed to high speed conveyor, i.e., lead-in, tapes. The high speed conveyer tapes form a nip at a pair of lead-in tape exit rollers for releasing the signatures. The high speed conveyor tapes conduct the signatures to a location in the mediate vicinity of the respective fans of the two fan arrangements, where they are released. It is readily apparent that the fan wheel circumferences intersect with each other and that there are provided devices on each blade of the fan wheel to prevent the fan blade tips from colliding with each other. By means of this configuration a delivery of a stream of signatures released from the high speed conveyor tapes into two fan wheels can be accomplished.

Currently, the lead-in tape exit rollers are mounted, at the same height, on respective studs via respective brackets. One of the brackets is fixed to one stud, while the other bracket is torsionally loaded on the other stud. This configuration provides a hard nip between the lead-in tape's exit rollers, which creates the positive drive force necessary to deliver severed signatures into the fan wheel arrangements below the lead-in tape exit rollers. However, there is a small gap—a head to tail space—between the signatures conveyed. This gap causes the lead-in tape rollers to bounce, which increases the risk of premature part failure. Moreover, the even height of the exit rollers causes pounding between the exit rollers, since there is a heavy spring-loaded pressure between the exit rollers. Premature failure of the bearings, tapes or other components may occur, as well as fretting corrosion of the loaded components. Another problem associated with even height of the corresponding exit rollers is slippage of exit roller brackets which hold the exit roller. Paper jams are more likely to occur between the heavily loaded exit rollers, which also may lead to bracket slippage or premature failure of components.

SUMMARY OF THE INVENTION

In accordance with the present invention, a folder apparatus includes at least one lead-in mechanism, the lead-in mechanism having a left lead-in tape and a left exit roller and a corresponding right lead-in tape and a right exit roller, the right and left lead-in tapes forming a signature passage for delivery of signatures. The right exit roller rotates about a first axis and the left exit roller rotates about a second axis. At least one spring is assigned to at least one of the lead-in tapes above the corresponding lead-in tape rollers for biasing the tapes.

By positioning the springs behind the tapes, a predetermined force can be applied to the tapes resulting in a predetermined squeeze of the signatures. Thus, a positive nip is provided to maintain the correct head to tail space between the signatures in the conveyed stream of signatures.

Due to elasticity of the springs and their shape, a smooth transport for the signatures can be achieved, allowing for allocating the nip point deep in a fan blade intersecting region of the folder apparatus. By using the springs, a predetermined squeezing force, and thus the nip point, can be established in the intersecting region, thereby allowing the signatures to be driven into the corresponding fan pockets of the fan wheels. Furthermore, variations in signature thicknesses can easily be compensated for without causing bouncing of the lead-in tape exit rollers.

In a first embodiment of the present invention, the springs are mounted on a stationary frame in the folder apparatus. The springs may be designed as having an arc-like curvature in the tape contacting area, thereby allowing a nip point to be precisely defined. The springs are mounted behind the lead-in tape.

In accordance with a further embodiment of the present invention, the springs are mounted on brackets which are pivotable around axes. In this embodiment, the springs have a longitudinally extending portion. If two such springs are mounted opposite to each other, the longitudinally extending portions of the springs define a region which a squeezing force is applied to, thereby creating the positive nip necessary to maintain head to tail space.

In accordance with a still further embodiment of the present invention, the longitudinally extending portions of the springs have a length exceeding the gap—i.e. the head to tail distance—between two signatures. Since there is a predetermined squeezing force applied, the nip width remains constant and the gap between the signatures conveyed does not induce a bouncing of the lead-in tape exit rollers. Thus, by setting a constant nip width, the effects of the gaps between the signatures passing the nip point are eliminated.

Furthermore, the lead-in tape exit rollers in any of the above embodiments can be mounted at different heights thus allowing for a reduced mechanical stress of machine components. Such a configuration further reduces the problem of bouncing as well because the exit rollers no longer bounce against each other.

DETAILED DESCRIPTION OF THE INVENTION

Figure 1:
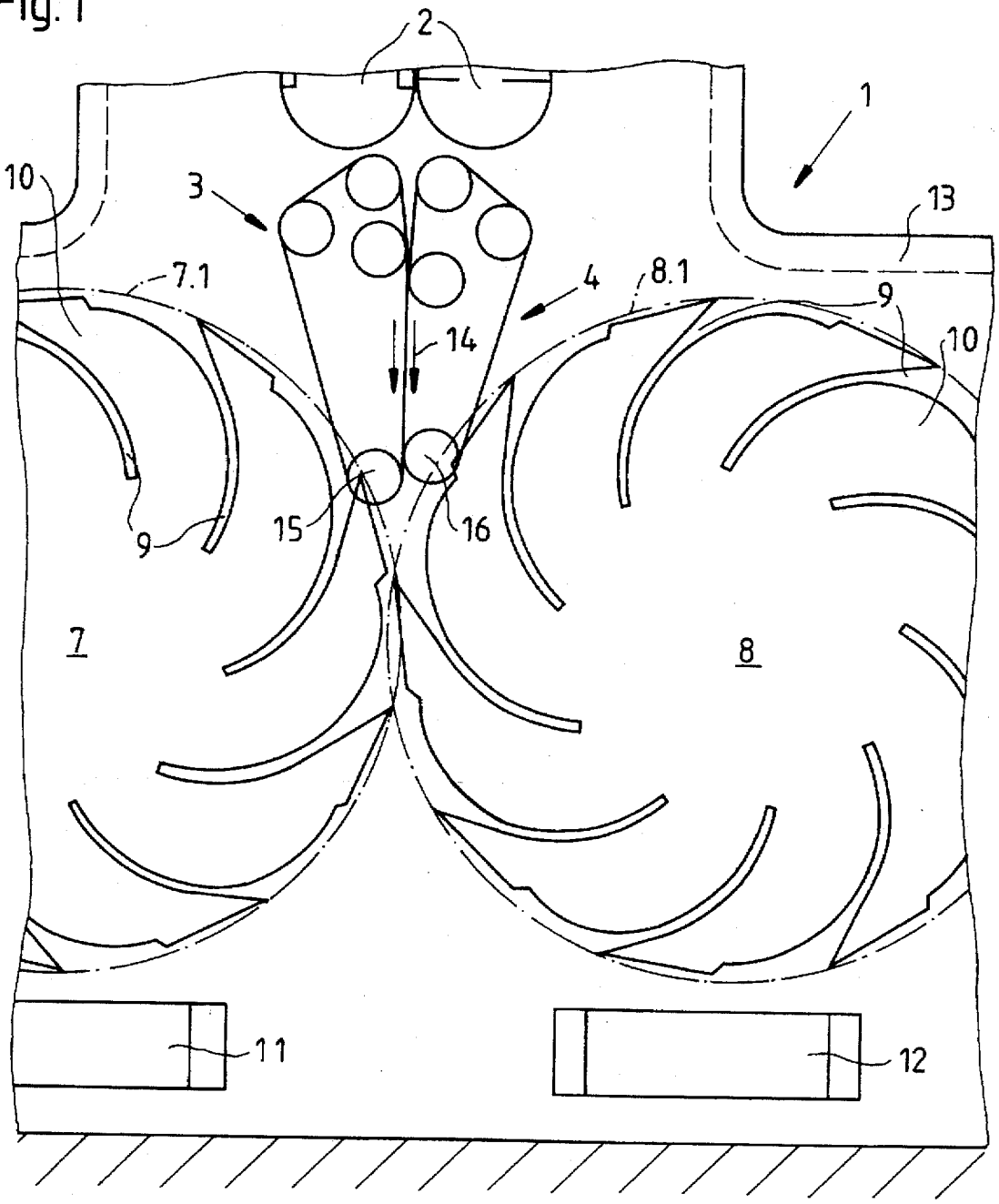
FIG. 1 shows a folder apparatus' delivery section with an intersecting fan wheel arrangement.

FIG. 1 shows a signature delivery device 1 within a folder apparatus. Signatures, severed from a web of paper between a pair of cutting cylinders 2 are fed to a high speed lead-in mechanism, having a left lead-in tape set 3 and a right lead-in tape set 4. The severed signatures are fed to pockets 9 of a first fan wheel 7 or a second fan wheel 8, respectively. In dashed lines, the corresponding envelope curve 7.1, 8.1 of the fan wheels 7, 8 are indicated, showing that the paths of the fan wheel blade tips 10 intersect each other during rotation. After the signatures are fed into the pockets 9 of the fan wheels 7 and 8 they are delivered on delivery belts 11 and 12, respectively. The manner in which the fan wheels cooperate to deliver the signatures to the delivery belts is discussed more fully in U.S. Pat. No. 5,112,033, the disclosure of which is hereby incorporated by reference. Reference numeral 13 identifies the frame of the folder apparatus.

The high speed lead-in mechanism, including the left lead-in tape set 3 and the right lead-in tape set 4, conveys signatures in the conveying direction as indicated by the arrows 14. The left lead-in tape exit rollers 15 and the corresponding right lead-in tape exit rollers 16 are mounted in a staggered configuration on the folder frame 13. An opposite arrangement of the lead-in tape exit rollers 15, 16, i.e. the position of the exit rollers 15 being higher than those of the exit rollers 16, is also possible.

Figure 2:
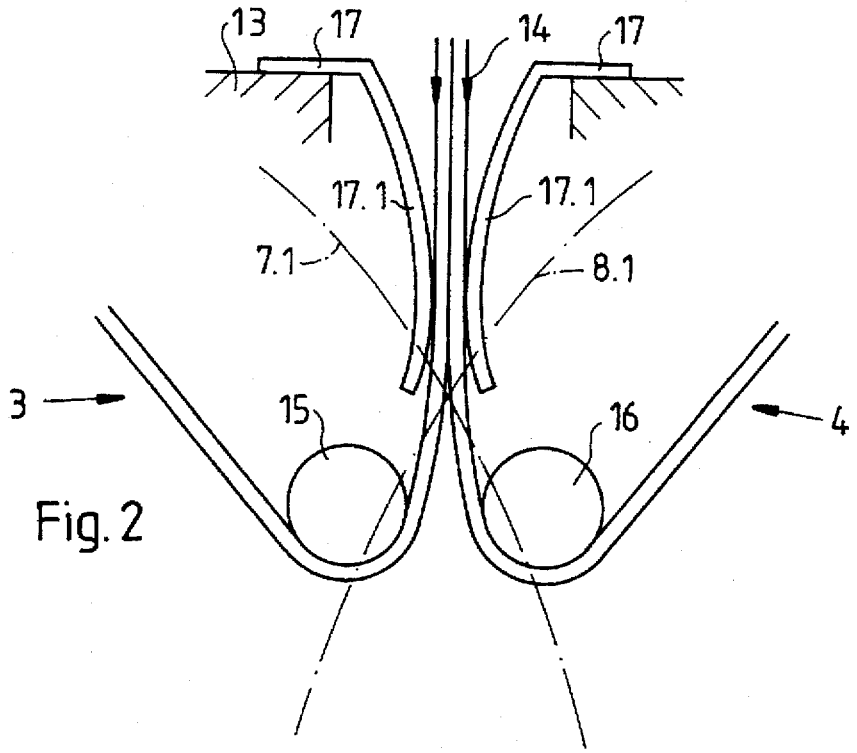
FIG. 2 shows stationary springs mounted on a frame in accordance with an embodiment of the present invention.

FIG. 2 shows a first embodiment of the present invention in which springs 17 are fixed to the frame 13. The springs 17 are applied to the back of the left and right lead-in tapes 3 and 4, respectively, to provide a squeezing force in the tape contacting area. The springs 17 each have an arc like curvature 17.1 for precisely defining not only the amount of force, but also the area on the lead-in tape's back side to which this force is applied. In the embodiment according to FIG. 2, the lead-in tape exit rollers 15 and 16, respectively are mounted opposite to each other. Thus, the nip between the lead-in tapes 3 and 4 is established by the spring force exerted upon the back of each set of tapes. It is therefore evident that the nip point between the lead-in tapes 3, 4 is established close to the intersecting area of the fan wheels 7, 8, indicated by the first and second envelope curves 7.1 and 8.1, respectively. Thus, a pounding of the exit rollers 15, 16 is eliminated, since a setting of a nip width between the lead-in tape rollers can now be accomplished.

Figure 3:
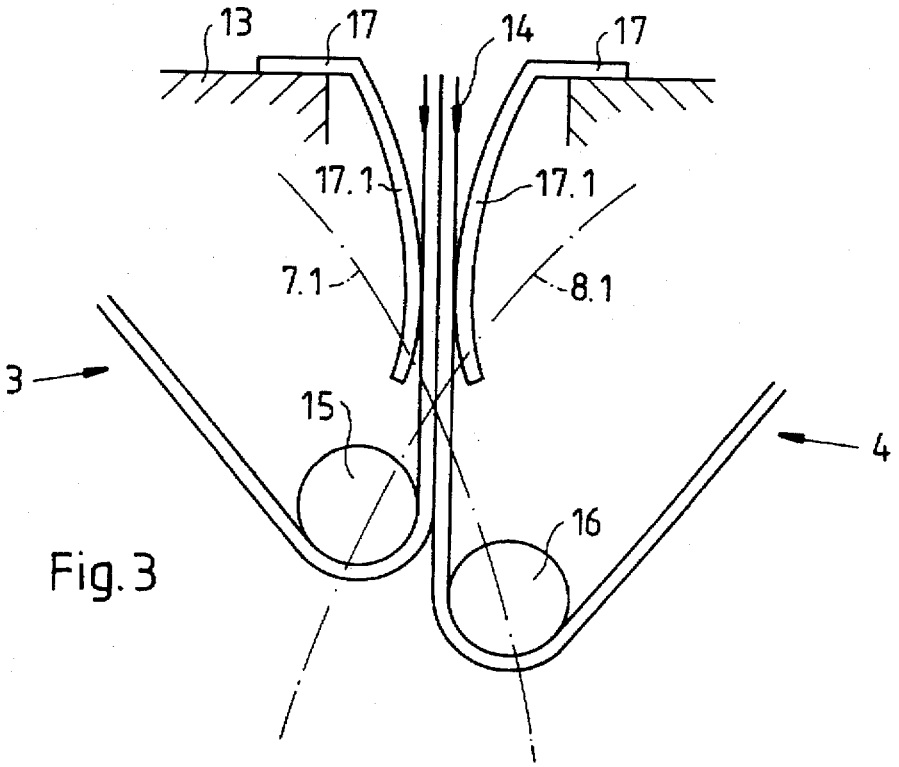
FIG. 3 shows springs mounted on a frame having lead-in tape exit rollers in a staggered configuration in accordance with another embodiment of the present invention.

FIG. 3 shows a spring configuration with springs 17 mounted on the folder frame 13 but having a staggered configuration with respect to each other. In accordance with this configuration, the nip point can be established within the intersecting fan paths 7.1 and 8.1, respectively, thereby allowing for the driving of the signatures into the pockets 9 of the fan wheels 7, 8. It is to be noted that the curvature of the intersecting fan paths 7.1, 8.1 is somewhat exaggerated in FIGS. 2 and 3.

Figure 4:
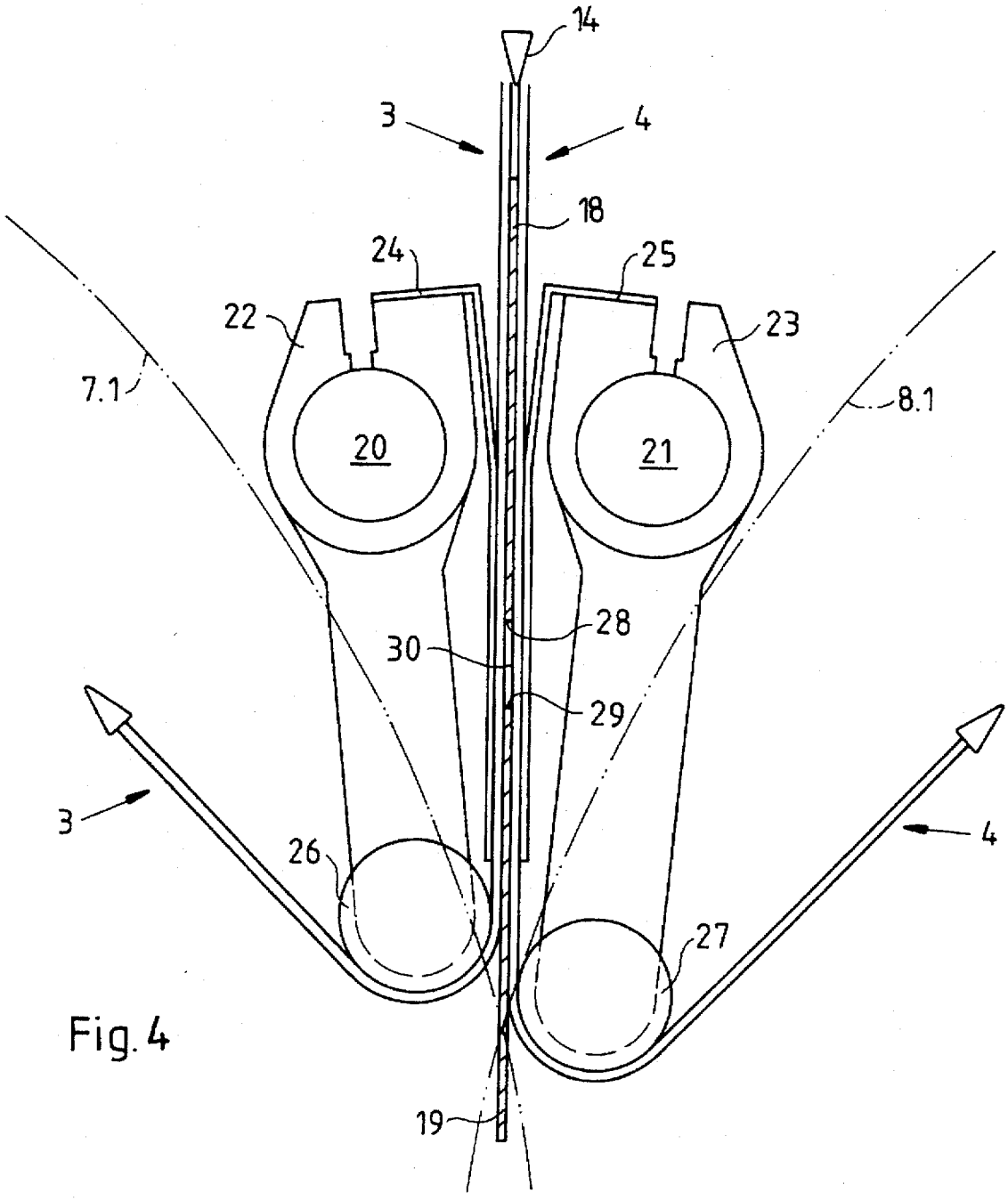
FIG. 4 shows longitudinally extending portions of spring means mounted on brackets in accordance with another embodiment of the present invention.

A still further embodiment of the present invention is shown in FIG. 4. In this embodiment the springs 24, 25 are mounted on brackets 22, 23 fixed on studs 20, 21 mounted on the frame 13. The brackets 22, 23 have left exit rollers 26 and fight exit rollers 27 affixed thereto, being arranged in a staggered configuration. The left set of lead-in tapes 3 and the right set of lead-in tapes 4 convey a first signature 18 and a second signature 19 into the conveying direction 14. It is important for signature delivery that a gap 30; i.e. the distance between a head 28 of a first signature 18 and a tail 29 of a second signature 19; is maintained until they reach the nip point between the lead-in tapes 3, 4 and the exit rollers 26, 27.

In accordance with the embodiment of FIG. 4, the longitudinally extending portions of the springs 24, 25 have a length exceeding the gap 30 between the first and the second signatures 18, 19. A constant defined nip width is established by rotationally adjusting the brackets 22, 23 on the studs 20, 21 when the folder is not in operation. By applying a constant squeezing force onto back sides of the lead-in tapes 3, 4, the presence of a gap 30 does not tend to induce bouncing of the lead-in tape exit rollers 26, 27. Since the longitudinally extending portions of the springs 24, 25 exceed the length of the gap 30, the presence of a gap 30 does not affect the nip width because head 28 and tail 29 of the signatures 18, 19 to be conveyed are covered by the nip area. Thus, a high frequency nip width change, particularly at high speeds, is avoided and bouncing of the exit rollers 26, 27 is eliminated. Furthermore, a sudden change in signature thickness can easily be compensated for since the length of the longitudinally extending portions of the springs 24, 25 cover the gap 30 between signatures taft 29 and head 28, so sudden changes in nip width do not occur.

In order to generate other nip characteristics, springs of a different stiffness can be mounted. An actuating unit for preadjusting a defined nip width between the lead-in tapes 3, 4 by altering the relative spring distances is also possible.

Figure 5:
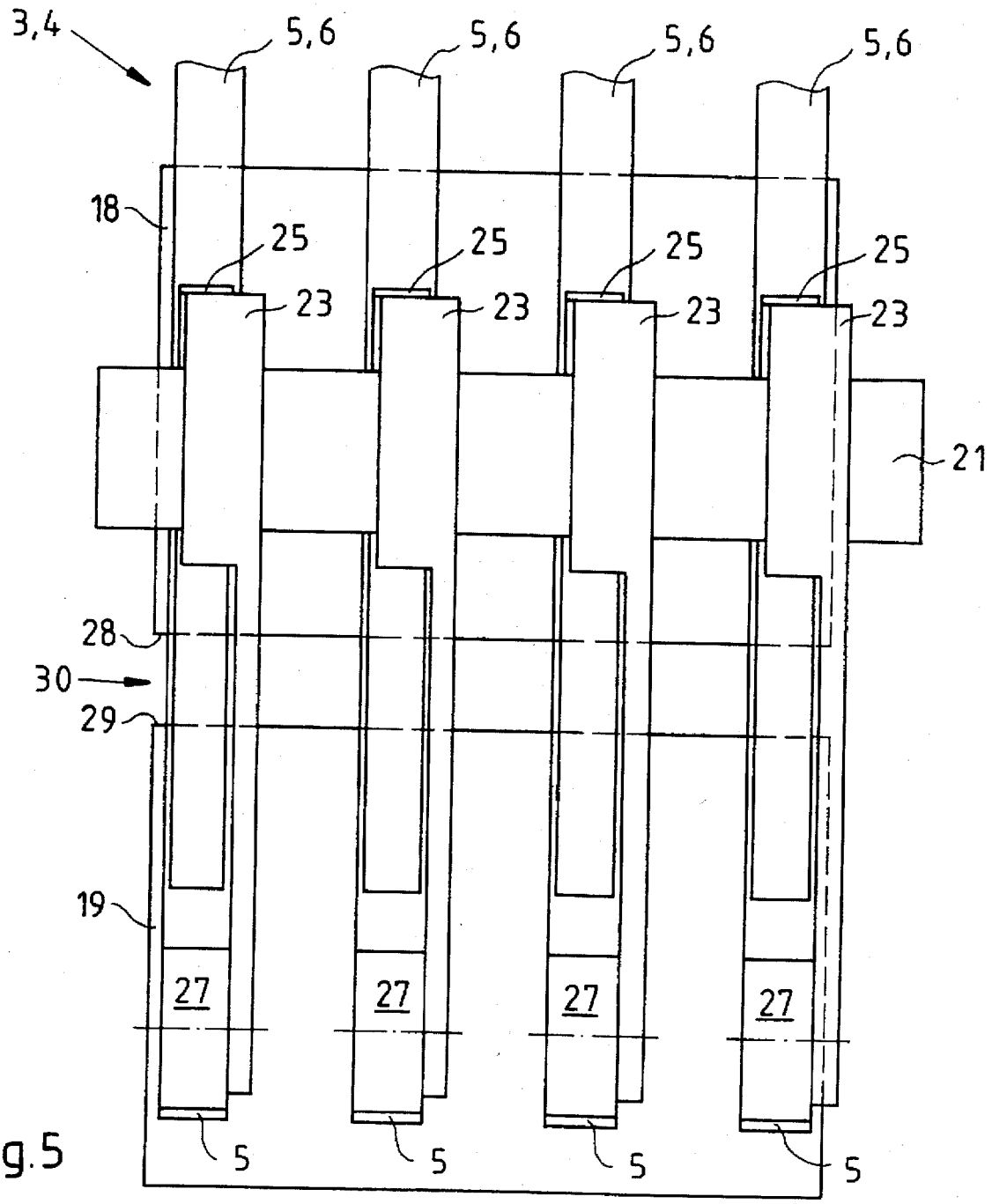
FIG. 5 shows a side view of the configuration of FIG. 4.

FIG. 5 shows a right side view of the embodiment according to FIG. 4. Referring to FIG. 5, it can be seen that the set of lead-in tapes 4 include individual tapes 5, located side by side to one another. Furthermore, it is to be noted, that the springs 25 mounted on the rotationally fixed brackets 23 on the studs 21 comprise a longitudinally extending portion bridging the gap 30 between the first signature 18 and the second signature 19.

What is claimed is:

1. A pair of sheet feeding conveyors comprising:

at least one lead-in mechanism, the lead-in mechanism having a left lead-in tape and a left exit roller, and a corresponding right lead-in tape and a right exit roller, the right and left lead-in tapes forming a signature passage for delivery of signatures, the right exit roller rotating about a first axis, the left exit roller rotating about a second axis; and at least one spring associated with at least one of the lead-in tapes, the spring disposed adjacent the corresponding lead-in tape roller, said spring contacting a surface of said at least one of the lead-in tapes for biasing the lead-in tapes.

2. The pair of sheet feeding conveyors according to claim 1, wherein the folder apparatus further includes a frame, the spring being mounted on the frame.

3. The pair of sheet feeding conveyors according to claim 1, wherein the folder apparatus further includes at least one bracket and at least one stud, the bracket being fixed to the stud, the spring being mounted on the bracket.

4. The pair of sheet feeding conveyors according to claim 1, wherein the right exit roller is mounted at a first height and the left exit roller is mounted at a second height.

5. The pair of sheet feeding conveyors according to claim 4, wherein the right exit roller is mounted higher than the left exit roller.

6. The pair of sheet feeding conveyors according to claim 4, wherein the left exit roller is mounted higher than the right exit roller.

7. The pair of sheet feeding conveyors according to claim 1, wherein the spring is actuated by an actuating unit to provide a squeezing force on the lead-in tapes.

8. The pair of sheet feeding conveyors according to claim 1, wherein the spring has an arc shaped curvature at a portion of the spring which contacts the lead-in tape.

9. The pair of sheet feeding conveyors according to claim 1, wherein the spring has a length which exceeds a gap between a first and a second signature to be conveyed.

10. The pair of sheet feeding conveyors according to claim 1, wherein each spring has a length which exceeds a gap between a first and a second signature to be conveyed.

11. A pair of sheet feeding conveyors comprising:

at least one lead-in mechanism, the lead-in mechanism having a left lead-in tape and a left exit roller, and a corresponding right lead-in tape and a right exit roller, the right and left lead-in tapes forming a signature passage for delivery of signatures, the right exit roller rotating about a first axis, the left exit roller rotating about a second axis; and a spring associated with each one of the lead-in tapes, each spring disposed adjacent a corresponding lead-in tape roller, each spring contacting a surface of a corresponding lead-in tape for biasing the lead-in tapes.

12. The pair of sheet feeding conveyors according to claim 11, wherein the folder apparatus further includes a frame, the spring being mounted on the frame.

13. The pair of sheet feeding conveyors according to claim 11, wherein the folder apparatus further includes at least one bracket and at least one stud, the bracket being fixed to the stud, the spring being mounted on the bracket.

14. The pair of sheet feeding conveyors according to claim 11, wherein the right exit roller is mounted at a first height and the left exit roller is mounted at a second height.

15. The pair of sheet feeding conveyors according to claim 14, wherein the right exit roller is mounted higher than the left exit roller.

16. The pair of sheet feeding conveyors according to claim 14, wherein the left exit roller is mounted higher than the right exit roller.

17. The pair of sheet feeding conveyors according to claim 11, wherein the springs are actuated by an actuating unit to provide a squeezing force on the lead-in tapes.

18. The pair of sheet feeding conveyors according to claim 11, wherein each spring has an arc shaped curvature at a portion of the spring which contacts the lead-in tape.

19. A sheet conveying apparatus comprising:

at least one lead-in mechanism, the lead-in mechanism having a left lead-in tape and a left exit roller, and a corresponding right lead-in tape and a right exit roller, the right and left lead-in tapes forming a signature passage for delivery of signatures, the right exit roller rotating about a first axis, the left exit roller rotating about a second axis;

a spring associated with each one of the lead-in tapes, each spring disposed adjacent a corresponding lead-in tape roller, each spring contacting a surface of a corresponding lead-in tape for biasing the lead-in tapes; and at least one fan wheel comprising pockets.

20. The sheet conveying apparatus of claim 19, further comprising:

a second fan wheel comprising pockets.

* * * * *